US005834110A

United States Patent [19]

Misawa et al.

[11] Patent Number: 5,834,110

[45] Date of Patent: Nov. 10, 1998

[54] POLYMER INSULATOR

[75] Inventors: Hidenobu Misawa, Kasugai; Yukihiro Koshino, Tajimi; Isao Nakajima, Nagoya, all of Japan

[73] Assignee: NGK Insulators, Ltd., Japan

[21] Appl. No.: 767,679

[22] Filed: Dec. 17, 1996

[30] Foreign Application Priority Data

Dec. 19, 1995 [JP] Japan ..... 7-330443

[51] Int. Cl.[6] ..... H01B 17/00

[52] U.S. Cl. ..... 428/328; 428/36.9; 428/36.91; 428/36.92; 428/331; 428/428; 428/429

[58] Field of Search ..... 428/331, 328, 428/428, 429, 36.9, 36.91, 36.92

[56] References Cited

U.S. PATENT DOCUMENTS

| | | | |
|---|---|---|---|
| 3,511,698 | 5/1970 | Talcott | 428/339 |
| 3,965,065 | 6/1976 | Elliott | 524/430 |
| 4,476,155 | 10/1984 | Niemi | 427/58 |
| 5,369,161 | 11/1994 | Kunieda et al. | 524/266 |

FOREIGN PATENT DOCUMENTS

| | | |
|---|---|---|
| 53-35982 | 3/1977 | Japan . |
| 59-198604 | 11/1984 | Japan . |
| 4-209655 | 7/1992 | Japan . |

*Primary Examiner*—D. S. Nakarani
*Attorney, Agent, or Firm*—Parkhurst & Wendel, L.L.P

[57] ABSTRACT

An excellent polymer insulator is provided which can be formed by casting a composition in a mold and which after heat-curing have a silicone rubber coating layer on an outer circumferential surface of a glass fiber-reinforced plastics core thereby providing superior electric insulation properties including weather resistance, tracking resistance and erosion resistance, etc. in severe conditions of air pollution, salt damaging or severe climate.

4 Claims, 1 Drawing Sheet

POLYMER INSULATOR

BACKGROUND OF THE INVENTION

1. Field of the Invention

The present invention relates to a polymer insulator and a method for producing the polymer insulator.

2. Related Art Statement

Generally, high voltage electric insulator bodies used in insulators for electric power supply lines are made of ceramics or glass. In environments, such as, coastal areas, industrial areas and similar areas suffering easily from pollution, there are problems in that a dry band discharge leading to flash-over occurs, a leakage current occurs and other disadvantages occur for the sake of adhesion of minute particles, salts, fogs, etc. on the surface of the high voltage electric insulators.

Therefore, various methods were proposed for solving the drawbacks of the ceramic or glass electric insulator bodies. For example, U.S. Pat. No. 3,511,698 proposed a weather-resistant high voltage electric insulator body having a member made of a curing resin and coated with a platinum catalyst-containing organo polysiloxane elastomer. In Japanese Patent Application Laid-open No. 59-198,604 corresponding to U.S. Pat. No. 4,476,155, a technique was proposed of maintaining high characteristic electric properties of the electric insulator bodies even in the presence of humidity, air pollution, UV ray or the like stresses in the fields, by applying a room temperature-curing type organopolysiloxane composition of one liquid type on the outer surface of the electric insulator bodies made of glass or ceramics. In Japanese Patent publication No. 53-35,982 corresponding to U.S. Pat. No. 3,965,065 and Japanese Patent Application Laid-open No. 4-209,655 corresponding to U.S. Pat. No. 5,369,161, methods were proposed of obtaining silicone rubber compositions having improved electric insulator bodies by applying and curing under heating a mixture of organopolysiloxane and aluminum hydroxide at a temperature higher than 100° C. for at least 30 min to form a silicone rubber.

However, all the conventional techniques have disadvantages in that the high voltage electric insulating properties of the used silicone rubber materials were still insufficient and a long time was required for curing used silicone rubber. For curing a High Temperature Vulcanizing type silicone rubber an organic peroxide was frequently used, as described in Japanese Patent Application Laid-open No. 4-209,655. However, cross-linking of the silicone rubber materials by means of the organic peroxide inevitably necessitated much manpowers and an automated production process could hardly be realized, because the silicone rubber materials contained a highly viscous organopolysiloxane in a crude rubber (i.e. gum) state as a main component and hence both a blending in roll blender and a splitting-extruding work which affords a supply of the extruded materials of a suitable form to a shaping apparatus.

Meanwhile, when the addition-curing type silicone rubber material of a heretofore used viscosity range exceeding 1,000 poises was shaped by injection molding, there arose problems in that the mold had a complicated shape and air could hardly be drawn out, so that the percentage of defects of the product was high, large size insulator pipes were especially difficult to mold, and the producing apparatus became large and expensive because of a high pressure of casting the rubber material.

SUMMARY OF THE INVENTION

It is an object of the present invention to obviate the above problems and drawbacks.

Another object of the present invention is to provide a polymer insulator that enables injection molding and forms a coating layer of silicone rubber after heat-curing on the outer circumference of the core made of a glass fiber-reinforced synthetic resin of the polymer insulator, thereby to exhibit superior weather resistant property, tracking resistance, erosion resistant property and the like high voltage electric insulating property in a severe weather condition, air polluted condition, or salts- or fogs-coated condition.

A further object of the present invention will become apparent from the ensuing description, attached claims and drawings.

In order to achieve the above objects, the inventors accomplished the present invention of the polymer insulator in a simple, easy, efficient and cost-reducing way by casting an addition-curing type silicone rubber composition having a viscosity of not more than 1,000 poises, preferably not more than 500 poises, at 25° C. in a mold, curing the silicone rubber composition under heating in the mold thereby to coat the outer circumference of the glass fiber-reinforced synthetic resin core.

The addition-curing type silicone rubber composition is preferably composed of the following components (A), (B), (C) and (D).

(A) an alkenyl group-containing organopolysiloxane of a polymerization degree of 100–500 having the following average compositional formula:

$$R^1_aR^2_bSiO_{(4-a-b)/2} \quad (1)$$

wherein $R^1$ is a substituted or nonsubstituted monovalent hydrocarbon group not having an aliphatic unsaturated bond, at least 90 mol % of total $R^1$ being a methyl group, $R^2$ is an alkenyl group, a is a number of 1.85–2.10, b is a number of 0.004–0.2, a+b is a number of 1.854–2.30, (B) an organohydrogenpolysiloxane having in the molecule at least two hydrogen atoms bonded to silicon atoms and containing the hydrogen atoms bonded to the silicon atoms in an amount of capable of supplying 0.5–10 moles of the hydrogen atoms to one mole of the alkenyl group of the component (A), (C) a catalytic amount of platinum compound, and (D) a reinforcing silica having a specific surface area of not less than 50 $m^2/g$ and a primary diameter of not more than 100 nm and being contained in an amount of 1–40 parts by weight relative to 100 parts by weight of the component (A).

The present invention provides also a method for producing the polymer insulator wherein a core made of a glass fiber reinforced synthetic resin is arranged in a mold, a liquid addition-curing type silicone rubber composition is cast around the outer circumference of the core to coat the same and cured under heating, the method comprising using a two-halves type mold in which the core can be arranged such that the axis of the core is horizontal therein, the two-halves type mold being arranged such that the divided surfaces of the mold extend in the axial direction of the core and in the vertical direction, and forming the polymer insulator by opening and closing the divided surfaces of the mold in the horizontal direction.

Preferably, the polymer insulator is formed by using a mold having an inlet for casting the liquid addition-curing type silicone rubber composition at a lower portion than the central axis of the core.

Regarding the above producing method, the following points are noticed.

In a vertical mold, the factory building for accommodating the producing installation requires a large vertical space, so that the cost for constructing the factory building becomes high (sometimes, the product exceeds indeed a length of 7 m).

Even in a horizontal mold, if the mold opens upwardly and downwardly, the surfaces of the divided halves of the mold become horizontal, so that the casting inlet can scarcely be arranged at a portion lower than the central axis of the core and an air drawing hole can hardly be provided at a portion of the mold before the shade of the polymer insulator.

If the casting inlet is arranged at a portion higher than the central axis of the core, air is easily entrained in the casted material, so that defected products are likely produced.

By adopting the structure of the horizontal mold which opens rightwardly and leftwardly, many advantages can be obtained so that the producing method can be performed in an economical way wherein the vertical space of the factory building can be diminished, the casting inlet can be arranged at a portion lower than the central axis of the core, the air drawing hole can be provided at a portion of the mold before the shade of the polymer insulator, the cost of the producing installation can be reduced, and defective products are scarcely produced.

BRIEF DESCRIPTION OF THE DRAWING

For a better understanding of the present invention, reference is made to the accompanying drawings, in which.

Figure 1:
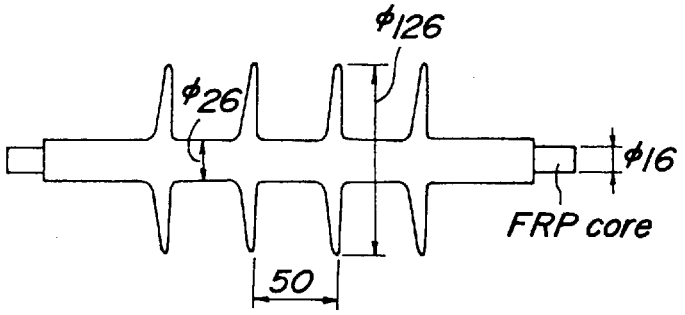
FIG. 1 is a schematic plan view of a solid type polymer insulator.
Figure 2:
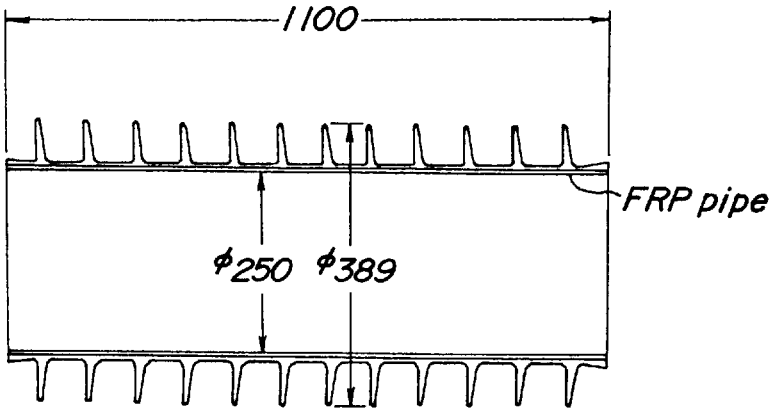
FIG. 2 is a schematic cross-sectional view of a hollow type polymer insulator.

In order to obtain the polymer insulators of FIGS. 1 and 2, trials were made of casting and forming the silicone rubber composition in the mold respectively one time for the insulators of FIGS. 1 and 2, the formed compositions showed only a half-cured state as estimated from the large value of T 50=19 min, so that the succeeding forming operations were stopped.

DETAILED EXPLANATION OF THE INVENTION

In the polymer insulator of the present invention, the addition-curing type silicone rubber composition preferably comprises the components (A), (B), (C) and (D) mentioned above.

An alkenyl group-containing organopolysiloxane represented by the above-mentioned average compositional formula (1) as component (A) is a base polymer of the addition-curing type silicone rubber composition.

In the general formula (1) of the component (A), $R^1$ is a substituted or nonsubstituted monovalent hydrocarbon group not having an aliphatic unsaturated bond and having carbon atoms of 1–12, preferably 1–6. Concretely, $R^1$ is an alkyl group, such as, methyl, ethyl, propyl, butyl, etc.; a cycloalkyl group, such as, cyclohexyl, etc.; an aryl group, such as, phenyl, tolyl, etc.; an aralkyl group, such as, benzyl, phenylethyl, etc.; an substituted alkyl group substituted by halogen atom, etc., such as 3-chloro propyl, etc. At least 90 mol %, preferably at least 95 mol % (i.e. 95–100 mol %), of the $R^1$ groups must be methyl groups. This is because, if the content of methyl groups is less than 90 mol %, the carbon atoms number in the component (A) becomes excessively large and thus is carbonized in a tracking test or the like electric test thereby to easily form a conducting circuit. Illustrative examples of $R^2$ are vinyl, aryl, propenyl, isopropenyl, butenyl, hexenyl and the like having about 2–6 carbon atoms.

Letter a is a number of $1.85 \leqq a \leqq 2.10$, preferably $1.90 \leqq a \leqq 2.05$, letter b is a number of $0.004 \leqq b \leqq 0.2$, preferably $0.005 \leqq b \leqq 0.15$, a+b is a number of $1.854 \leqq a+b \leqq 2.30$, preferably $1.955 \leqq a+b \leqq 2.06$. If b is less than 0.004, molecules only having not more than one aliphatic unsaturated group become so numerous that sufficient strength can not be attained, or if the molecules do have not less than two carbon atoms then the molecular weight thereof becomes excessively large so that the necessary viscosity of not more than 1,000 poises can not be satisfied. Polymerization degree (or a number of silicon atoms in the molecule) of the alkenyl group-containing organopolysiloxane is 100–500, preferably about 150–450. If the polymerization degree is less than 100, physical properties of rubber can not be exhibited sufficiently, while if it exceeds 500, the viscosity of 1,000 poises of the addition-curing type silicone rubber composition at 25° C. can hardly be satisfied.

The organopolysiloxane may have a linear shape or a branched shape having a $RSiO_{3/2}$ unit or a $SiO_{4/2}$ unit, wherein R represents the above $R^1$ or $R^2$. Usually, the main chain portion thereof is fundamentally composed of repeating of diorganosiloxane $R_2SiO_{2/2}$ units, and the organopolysiloxane is generally a linear diorganosiloxane which is closed at both terminal ends of the molecular chain (i.e. contained in $R_3SiO_{1/2}$ groups) with triorganosiloxyl $R_3SiO_{1/2}$ groups. The alkenyl groups contained in the organopolysiloxane of the component (A) may be those bonded to the silicon atoms at the terminal ends of the molecular chain (i.e. contained in $R_3SiO_{1/2}$ groups), those bonded to the silicon atoms at the intermediate positions of the molecular chain (i.e. contained in $R_2SiO_{2/2}$ units) or those bonded to the silicon atoms (i.e. SiH groups) both at the terminal ends and the intermediate positions of the molecular chain. From the view point of curing property or mechanical strength of the cured silicone rubber, the alkenyl groups preferably comprise at least alkenyl groups bonded to the both terminal ends of the molecular chain. Such an organopolysiloxane can be produced by known methods, such as, equilibrating reaction of organocyclopolysiloxane and hexaorganodisiloxane in the presence of a caustic or acidic catalyst.

The organohydrogenpolysiloxane of the component (B) functions as a cross-linking agent of the addition-curing type silicone rubber composition according to the present invention, and the hydrogen atoms bonded to the silicon atoms i.e. SiH groups of the component (B) are addition-reacted (hydrosilylated) to the alkenyl groups of the component (A) in the presence of the platinum series catalyst of the component (C) thereby to result in cross-linking and curing of the composition.

The organohydrogenpolysiloxane of the component (B) should have at least two, preferably at least 3, hydrogen atoms bonded to the silicon atoms of the component (B). In such circumstances, illustrative examples of organic groups other than the hydrogen atoms bonded to the silicon atoms are substituted or unsubstituted monovalent hydrocarbon groups, preferably free from an aliphatic unsaturated bond, for example, alkyl groups, such as, methyl, ethyl, propyl, butyl, etc.; cycloalkyl groups, such as, cyclohexyl, etc.; aryl groups, such as, phenyl, tolyl, etc.; aralkyl groups, such as, benzyl, phenyl ethyl, etc.; substituted alkyl groups, such as, 3,3,3-trichloro propyl, 3-chloro propyl, etc. The component (B) may have any molecular structure of linear, branched, cyclic or three-dimensional network. Though the component (B) has no limitation as to molecular weight, it has preferably a liquid state at ambient temperature, and a viscosity of 0.5–1,000 centipoises, particularly 3–500 centipoises, at 25° C.

The component (B) is present in the rubber composition in an amount of a mole ratio of the moles of the hydrogen atoms bonded to the silicon atoms (i.e. SiH groups) of the component (B) to the moles of the alkenyl groups in the component (A) of 0.5:1–10:1, preferably 0.8:1–5:1. This is because, if the moles of the hydrogen atoms bonded to the silicon atoms in the component (B) are less than 0.5 relative to 1 mole of the alkenyl groups in the component (A), a sufficient curing cannot be attained, while if it exceeds 10, the cured rubber composition is liable to generate foams.

The organohydrogenpolysiloxane of the component (B) is preferably organohydrogenpolysiloxanes of a liquid state at ambient temperature (ex. 25° C.) having at least 2, preferably at least 3, hydrogen atoms bonded to the silicon atoms and having concretely the following compositional formula;

$$R^4{}_dH_cSiO_{(4-d-c)/2} \quad (2)$$

wherein $R^4$ is a substituted or nonsubstituted monovalent hydrocarbon group having 1–10 carbon atoms, preferably 1–8 carbon atoms and not having an aliphatic unsaturated bond, illustrative examples of which are the same as those of $R^1$, letter d is a number of 0.7–2.1, preferably 1–2, letter c is a number of 0.002–1, preferably 0.01–0.5, and d+c is a positive number of satisfying a number of 0.8–3, preferably 1.5–2.6.

As such organohydrogenpolysiloxanes are mentioned methylhydrogenpolysiloxane having trimethylsiloxyl group for closing at the both terminal ends, a dimethylsiloxane/methylhydrogensiloxane copolymer having trimethylsiloxyl groups for closing at both terminal ends, dimethylpolysiloxane having dimethylhydrogensiloxyl groups for closing at the both terminal ends, dimethylsiloxane/methylhydrogensiloxane copolymer having dimethylhydrogensiloxyl groups for closing at both terminal ends, methylhydrogensiloxane.diphenylsiloxane.dimethylsiloxane copolymer having trimethyl siloxyl groups for closing at the both terminal ends, copolymers made of a unit of $(CH_3)_2HSiO_{1/2}$ and a unit of $SiO_{4/2}$, and copolymers made of a unit of $(CH_3)_2HSiO_{1/2}$, a unit of $SiO_{4/2}$ and a unit of $(C_6H_5)SiO_{3/2}$.

Such organohydrogenpolysiloxanes of the component (B) can be produced by publicly known methods. For example, they can easily be produced by equilibrating octamethylcyclotetrasiloxane and/or tetramethylcyclotetrasiloxane and hexamethyldisiloxane which can be formed as terminal groups, or a compound having a terminal unit of diorganohydrogensiloxy or triorganosiloxy, such as, 1,3-dihydro-1,1,3,3-tetramethyl disiloxane, in the presence of a catalyst, such as, sulfuric acid, trifluoromethane sulfonic acid or methane sulfonic acid, etc. at a temperature of around −10° C.–+40° C.

The platinum series catalysts of the component (C) are for curing the silicone rubber composition of curable property. AS such catalysts are mentioned chloroplatinic acid, an alcoholic solution of chloroplatinic acid, complexed compounds of chloroplatinic acid and olefines, aldehydes, vinylsiloxanes, or acetylene-alcohols, etc., platinum black or platinum supported on a carrier. The amount of the component (C) to be added to the silicone rubber composition is 0.1–500 parts by weight calculated as platinum metal relative to a summed amount of 1 million parts by weight of the component (A) and the component (B). An amount of the component (C) of 1–100 parts by weight is preferable. If the amount is less than 0.1 part by weight, the curing does not proceed sufficiently, while if it exceeds 500 parts by weight, the resultant products become uneconomical.

The reinforcing silica of the component (C) is present for improving the strength of the silicone rubber and has a specific surface area measured by BET method of not less than 50 $m^2/g$, usually 50–500 $m^2/g$, particularly about 100–400 $m^2/g$. The silica must have a primary particle diameter (for example, as weight average value measured by laser beam diffraction analysis techniques, etc.) of not more than 100 nm. If the silica has a larger primary particle diameter to have a smaller specific surface area, the reinforcing function thereof is not sufficient. The amount of the reinforcing silica to be use is 1–40 parts by weight, preferably 3–30 parts by weight relative to a summed amount of 100 parts by weight of the component (A) and the component (B). As such reinforcing fillers are mentioned, for example, fine powder silica, such as, fumed silica, sedimented silica, etc. and concretely illustrated as hydrophylic silica, such as, Aerosil 130, 200, 300 (produced by Nippon Aerosil Co. or Degussa Co.), Carbosil MS-5, MS-7 (produced by Cabot Co.), Rgeorosil QS-102, QS-103 (produced by Tokuyama Soda Co.) and Nipsil LP (produced by Nippon Silica Co.), etc., and hydrophobic silica, such as, Aerosil R-812, R-812S, R-972, R-974 (produced by Degussa Co.), Rheorosil MT-10, DM-20 (produced by Tokuyama Soda Co.), Nipsil SS series (produced by Nippon Silica Co.), etc.

In order to improve the tracking resistance of the addition-curing type silicone rubber composition of the present invention, aluminum hydroxide may be present in the composition. Aluminum hydroxide has the following formula;

$$Al_2O_3.3H_2O \quad (3)$$

Aluminum hydroxide has preferably an average particle diameter (for example, as weight average value measured by laser beam diffraction analysis techniques, etc.) of not more than 50 μm, particularly 0.5–20 μm. The aluminum hydroxide may be used alone or in admixture of at least two types. Particularly, when the aluminum hydroxide is used in admixture of at least two types, if aluminum hydroxide having, for example, an average particle diameter of 7–50 μm, particularly 9–30 μm, is co-used with aluminum hydroxide having, for example, an average particle diameter of less than 7 μm, for example, 0.1–6 μm, particularly 0.5–5 μm, a highly dense filling of the composition becomes possible and the increase of viscosity of the composition becomes small as compared with the case of the single reciping of the aluminum hydroxide. The aluminum hydroxide may be used as it is, or it may be used after treatment with a silane series- or titanate series-coupling agent, dimethylsiloxane oil or stearic acid, etc. Suitable amount of the aluminum hydroxide to be added is 50–300 parts by weight relative to 100 parts by weight of organopolysiloxane (A). If it is less than 50 parts by weight, improvements of the electric properties becomes insufficient, while if it exceeds 300 parts by weight, the viscosity of the composition becomes excessively large and further the filling of the composition in the mold becomes difficult.

In order to improve the electric insulating properties, such as, weather resistant property, shrinkage percentage, thermal expansion coefficient and tracking resistance, etc. spherical fused silica may be use in the composition. Spherical fused silica has preferably an average particle diameter (for example, as weight average value measured by laser beam diffraction analysis techniques, etc.) of not more than 40 μm, for example, about 0.1–40 μm. The spherical fused silica may be used alone or in admixture of at least two types. Particularly, when the spherical fused silica is used in admixture of at least two types, if spherical fused silica having, for example, an average particle diameter of 7–40 μm is co-used with spherical fused silica having, for example, an average particle diameter of less than 7 μm, for example, 0.1–6 μm, a highly dense filling of the composition becomes possible and the increase of the viscosity of the composition becomes small as compared with the case of the single reciping of the spherical fused silica. The spherical fused silica may be used as it is, or it may be used after treatment with a silane series- or titanate series-coupling agent, dimethylsiloxane oil or stearic acid, etc. Suitable amount of the spherical fused silica to be added is 100–500 parts by weight relative to 100 parts by weight of organopolysiloxane. If it is less than 100 parts by weight, improvements of the electric properties become insufficient, while if it exceeds 500 parts by weight, the viscosity of the composition becomes excessively large and further the filling of the composition in the mold becomes difficult.

Suitable curing property of the addition-curing type silicone rubber composition of the present invention should occur in 1–15 min, preferably not more than 10 min, by reaching a torque of 50% (T50) taking a torque of the curing composition at 30° C. after the elapse of 30 min as 100% in a measurement of the curing property by means of a discreometer. If T50 is less than 1 min, the viscosity of the composition at the mixing and defoaming operations becomes excessively large to hinder the operations and deficiency percentage of the large size products becomes high. If T50 exceeds 15 min, a prolonged time is required for the curing, so that the production becomes uneconomical from the aspect of molding cycle.

In order to improve the electric properties, an organopolysiloxane resin having the following general formula may be reciped;

$$(R^3{}_3SiO_{1/2})_x(SiO_2)y \quad (4)$$

wherein $R^3$ is a substituted or nonsubstituted monovalent hydrocarbon group and a portion thereof is alkenyl groups, and the alkenyl groups are contained in an amount of 0.00001–0.005 mole per 1 gram of organopolysiloxane resin, x and y are positive numbers satisfying the formulae $0.5 \leqq x/y \leqq 1.5$, and $x+y=1$.

The organopolysiloxane resin of the formula (4) may be present in the addition-curing type silicone rubber composition of the present invention in an amount of 5–200 parts by weight, preferably about 10–100 parts by weight, relative to 100 parts by weight of the organopolysiloxane of the component (A) of the composition. In such a case, x and y in the formula (4) are the same as described above, and more preferably positive numbers satisfying $0.65 \leqq x/y \leqq 1.3$, and $x+y=1$. If x/y is less than 0.5, the cured coating film is likely brittle, while if x/y exceeds 1.5, the cured coating film likely gives a sticky feeling. The organopolysiloxane resin fundamentally comprises the $R_3{}^3SiO_{1/2}$ unit and the $SiO_{4/2}$ unit, and, if necessary, may further comprise $R^3{}_2SiO_{2/2}$ unit and $R^3SiO_{3/2}$ unit in such an amount that the purpose of the present invention is not damaged, for example, respectively of around up to 10 mole % relative to the sum of x+y.

In the above described range of the amount of the alkenyl groups, if the alkenyl groups are less than 0.00001 mole/g, the reinforcing effect can not be attained, while if it exceeds 0.005 mole/g, the cured products become brittle.

In addition, various additives may be reciped in the addition-curing type silicone rubber compositions in order to adjust the fluidity or improve the mechanical strength of the products, so far as the purpose of the present invention (electrical properties) are not damaged. As such additives are mentioned, for example, titanium oxide, pulverized quartz, diatomaceous earth, asbestos, aluminosilicate, ferrous or ferric oxide, zinc oxide, zinc carbonate, calcium carbonate, etc. Moreover, if necessary, pigment, heat-resistive agent, fire retardant, inner releasing agent, plasticizer, non-functional silicone oil, etc. may be added.

In case when the adjustment of the curing time is necessary for practically using these materials, addition reaction-controlling agents may be added, for example, vinyl group-containing organopolysiloxane, such as, vinylcyclotetrasiloxane, triallylisocyanurate, alkylmaleate, acetylenealcohols and their silane- and siloxane-derivatives, hydroperoxide, tetraethylethylenediamine, benzotriazol and mixtures thereof.

The addition-curing type silicone rubber composition of the present invention can be obtained by homogeneously mixing the above-described components (A)–(D) and the optional components, the silicone rubber composition should be a liquid composition having a viscosity of not more than 1,000 poises at 25° C., usually 50–1,000 poises, preferably 100–500 poises. If the viscosity exceeds 1,000 poises, the composition results in the defectedly formed production of insufficiently filled products at the time of casting the composition in the mold and curing under heating to form the cured coating layer of the silicone rubber around the outer circumference of the glass fiber-reinforced plastics core.

The silicone rubber composition of the present invention is easily cured at a primary curing condition usually of a temperature of 60°–120° C. for about 10 min–4 hrs and an optional secondary curing condition of a temperature of 60°–250° C. for about 10 min–4 hrs to form the cured coating layer of the silicone rubber around the outer circumference of the core.

Moreover, in the present invention, by using a casting rate of the silicone rubber in the horizontally divided mold of 0.1–20 liters/min, preferably 0.5–10 liters/min and providing an air drawing hole at the upper portion of the mold, preferably at the portion before the shade, the silicone rubber composition can be formed even by means of a single casting inlet at the lower side of the mold without generating foams and insufficiently filled portions even at the shade portion or the central body portion of the polymer insulator or pipe.

By virtue of these advantageous effects, insulators and insulator pipes of large sizes and complicated shapes which were heretofore difficult to produce can easily be produced.

EMBODIMENTS

Hereinafter, the present invention will be explained in more detail with reference to preferred examples in which all the parts are shown by weight basis, the viscosities were measured at 25° C. and the specific surface areas were measured by BET method.

Chemical structural formulae of the compounds (1), (2), (4)–(7) and (9) used in the Examples and Comparative Examples are shown below for reference. Dimethylpolysiloxane (1)

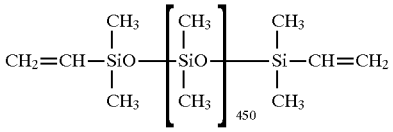

Dimethylpolysiloxane (2)

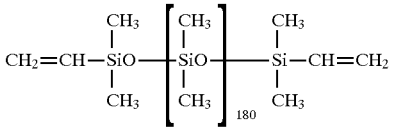

Methylhydrogenpolysiloxane (4)

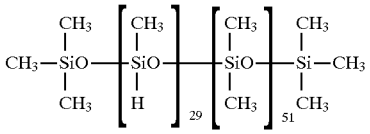

Organopolysiloxane resin (5)

$(Me_3SiO_{1/2})x(ViMe_2SiO_{1/2})y(SiO_2)z$ wherein x:y:z=666:100:900, x+y+z=1, the amount of vinyl group is 0.00085 mol/g Me is $CH_3$—, and Vi is $CH_2$=CH—

Dimethylpolysiloxane (6)

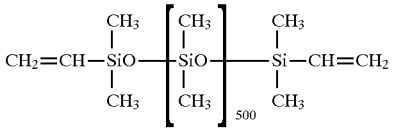

Dimethylsiloxane/diphenylsiloxane copolymer (7)

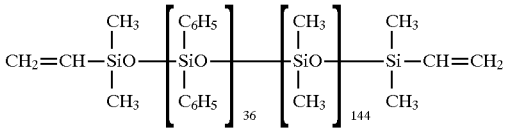

wherein the amount of methyl group to the sum of methyl group and phenyl group is 80 mole %.

Dimethylsiloxane/diphenylsiloxane copolymer (9)

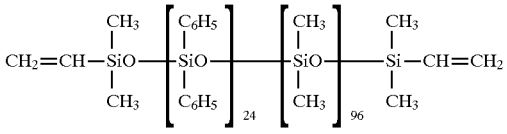

wherein the amount of methyl group to the sum of methyl group and phenyl group is 80 mole %.

EXAMPLE 1

60 parts of dimethylpolysiloxane (1) of a polymerization degree of around 450 having respectively a vinyldimethylsiloxyl group at the both terminal ends of the polymer chain for closing, 10 parts of hexamethyldisilazane and 4 parts by weight of water are charged in a kneader mixer and added with 40 parts of fumed silica Aerosil (Aerosil A 200 produced by Nippon Aerosil Co.) having a specific surface area of 200 $m^2/g$ and continuously stirred as they are for 1 hr, then heated up to an inner temperature of 150° C. and stirred for an additional 3 hrs, cooled to a temperature of not more than 100° C., thereafter added with 30 parts of dimethylpolysiloxane (2) of a polymerization degree of around 180 having respectively a vinyldimethylsiloxyl group at both terminal ends of the polymer chain for closing and continuously stirred for at least 15 min to obtain a liquids silicone rubber base (1).

To the liquids silicone rubber base (1) are added 20 parts of the abovedescribed dimethylpolysiloxane (2), 4.3 parts of methylhydrogenpolysiloxane (4), 0.20 part of a solution of 1% chloroplatinic acid in ethylhexanol and 0.02 part of ethynylhexanol and mixed in a planetary mixer. Then, the mixture is defoamed to obtain a silicone rubber composition (S1). The composition has a viscosity of 320 poises at 25° C. measured by a rotatory viscosimeter (BL-4-6). In addition, the composition is measured on its curing property at 80° C. by a discreometer. A torque at an elapse of a curing time of 30 min is taken as 100%, and a time T 50 is measured which is required for a torque of 50%. As a result, T 50 is 3 min and 20 sec.

The composition is cast by means of a metering charger in a mold held at 50° C. at a pressure of 3–4 $kgf/cm^2$ and a rate of 3 liters/min and then the mold temperature is elevated to 80° C. in 10 min and held thereat for 10 min to obtain 50 solid polymer insulators of FIG. 1 or 50 hollow polymer insulator pipes of FIG. 2. All the resultant insulators and insulator pipes have no unfilling portion and show good cured state. The above casting of the composition in the mold is performed by casting the composition from a casting inlet positioned at a portion lower than the central axis of the core disposed in the horizontally arranged mold of a rightwardly and leftwardly opening type. In addition, a primer is applied on the core before casting the silicone rubber composition in order to prevent formation of gaps between the interfaces of the core and the outer coating which causes insulation deficiency. These operations are effected in the similar way in the following examples.

Figure 3:
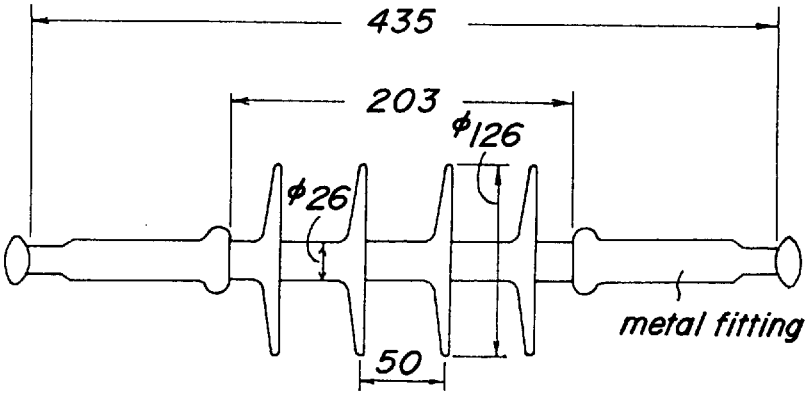
FIG. 3 is a schematic plan view of the solid type polymer insulator of FIG. 1 having metal fittings attached at both ends.

To the both ends of the formed product shown in FIG. 1 are attached metal fittings as shown in FIG. 3 and tested for evaluation of its electric properties by a tracking wheel test of CEA LW1WG-01(91) standard. As a result, they have properties sufficiently clearing the standard.

EXAMPLE 2

70 parts of dimethylpolysiloxane (1) which is similar to that of Example 1, 80 parts of dimethylpolysiloxane (2) which is similar to that of Example 1, 50 parts of organopolysiloxane resin (5), 400 parts of aluminum hydroxide having an average particle diameter of 8 $\mu$m and a specific surface area of 2 $m^2/g$ and 5 parts of hydrophobic fumed silica (Aerosil R-972 produced by Nippon Aerosil Co.) having a specific surface area of 120 $m^2/g$ are charged in a planetary mixer and stirred at 150° C. for 1 hr. After being cooled to room temperature, the mixture is added and mixed with 12 parts of methylhydrogenpolysiloxane (4) which is similar to that of Example 1, 0.2 part of a solution of 1% chloroplatinic acid in ethyl hexanol and 0.02 part of ethynylhexanol in a planetary mixer and then defoamed to obtain a silicone rubber composition (S2). The composition (S2) has a viscosity of 410 poises at 25° C. measured on a rotatory viscosimeter (BL-4-6).

In addition, the composition is measured on its curing property at 80° C. by a discreometer in the same manner as in Example 1 to obtain T50 of 5 min and 10 sec.

The cured products obtained in the similar manner as in Example 1 have no unfilling portion and show good cured state. Namely, 50 insulators shown in FIG. 1 and 50 insulator pipes shown in FIG. 2 are produced in Example 2 and the sum of all 100 insulators and insulator pipes have no unfilling portion and show good cured state.

The products are tested on a tracking wheel test similarly as in Example 1. As a result, they have properties sufficiently clearing the standard.

EXAMPLE 3

70 parts of dimethylpolysiloxane (1) which is similar to that of Example 1, 80 parts of dimethylpolysiloxane (2) which is similar to that of Example 1, 50 parts of organopolysiloxane resin (5), 400 parts of aluminum hydroxide having an average particle diameter of 8 $\mu$m and a specific surface area of 2 $m^2/g$, 5 parts of hydrophobic fumed silica (Aerosil R-972 produced by Nippon Aerosil Co.) having a specific surface area of 120 $m^2/g$, 10 parts of hexamethyldisilazan and 4 parts of water are charged in a kneader mixer and stirred at 150° C. for 3 hr. After being cooled to room temperature, the mixture is transferred in a planetary mixer and added and mixed with 12 parts of methylhydrogenpolysiloxane (4) which is similar to that of Example 1, 0.2 part of a solution of 1% chloroplatinic acid in ethyl hexanol and 0.02 part of ethynylhexanol and then defoamed to obtain a silicone rubber composition (S3). The composition (S3) has a viscosity of 280 poises at 25° C. measured on a rotatory viscosimeter (BL-4-6). In addition, curing property of the composition is measured in the same manner as in Example 1 to obtain T50 of 4 min and 52 sec.

The cured products obtained in the similar manner as in Example 1 have no unfilling portion and show good cured state. Namely, 50 insulators shown in FIG. 1 and 50 insulator pipes shown in FIG. 2 are produced in Example 2 and the sum of all 100 insulators and insulator pipes have no unfilling portion and show good cured state.

The products are tested on a tracking wheel test similarly as in Example 1. As a result, they have properties sufficiently clearing the standard.

EXAMPLE 4

80 parts of dimethylpolysiloxane (1) which is similar to that of Example 1, 70 parts of dimethylpolysiloxane (2) which is similar to that of Example 1, 50 parts of organopolysiloxane resin (5), 400 parts of spherical fused silica having an average particle diameter of 3 $\mu$m and 5 parts of hydrophobic fumed silica (Aerosil R-972 produced by Nippon Aerosil Co.) having a specific surface area of 120 $m^2/g$ are charged in a planetary mixer and stirred at 150° C. for 1 hr. After being cooled to room temperature, the mixture is added and mixed with 12 parts of methylhydrogenpolysiloxane (4) which is similar to that of Example 1, 0.20 part of a solution of 1% chloroplatinic acid in ethyl hexanol and 0.02 part of ethynylhexanol in a planetary mixer and then defoamed to obtain a silicone rubber composition (S4). The composition (S4) has a viscosity of 350 poises at 25° C. measured on a rotatory viscosimeter (BL-4-6). The composition has curing property of T50 of 4 min and 45 sec.

The cured products obtained in the similar manner as in Example 1 have no unfilling portion and show good cured state. Namely, 50 insulators shown in FIG. 1 and 50 insulator pipes shown in FIG. 2 are produced in Example 2 and the sum of all 100 insulators and insulator pipes have no unfilling portion and show good cured state.

The products are tested on a tracking wheel test similarly as in Example 1. As a result, they have properties sufficiently clearing the standard.

EXAMPLE 5

70 parts of dimethylpolysiloxane (1) which is similar to that of Example 1, 80 parts of dimethylpolysiloxane (2) which is similar to that of Example 1, 50 parts of organopolysiloxane resin (5), 300 parts of aluminum hydroxide having an average particle diameter of 21 $\mu$m and a specific surface area of 1.6 $m^2/g$, 100 parts of aluminum hydroxide having an average particle diameter of 1.1 $\mu$m and a specific surface area of 5 $m^2/g$ and 5 parts of hydrophobic fumed silica (Aerosil R-972 produced by Nippon Aerosil Co.) having a specific surface area of 120 $m^2/g$ are charged in a planetary mixer and stirred at 150° C. for 1 hr. After cooled to room temperature, the mixture is added and mixed with 12 parts of methylhydrogenpolysiloxane (4) which is similar to that of Example 1, 0.20 part of a solution of 1% chloroplatinic acid in ethyl hexanol and 0.02 part of ethynylhexanol in the planetary mixer and then defoamed to obtain a silicone rubber composition (S5). The composition (S5) has a viscosity of 250 poises at 25° C. measured on a rotatory viscosimeter (BL-4-6). T50 is 5 min and 05 sec.

The cured products obtained in the similar manner as in Example 1 have no unfilling portion and show good cured state. Namely, 50 insulators shown in FIG. 1 and 50 insulator pipes shown in FIG. 2 are produced in Example 2 and the sum of all 100 insulators and insulator pipes have no unfilling portion and show good cured state.

The products are tested on a tracking wheel test similarly as in Example 1. As a result, they have properties sufficiently clearing the standard.

COMPARATIVE EXAMPLE 1

60parts of dimethylpolysiloxane (6) of a polymerization degree of around 500 having respectively a vinyldimethylsiloxyl group at both terminal ends of the polymer chain for closing, 10 parts of hexamethyldisilazane and 4 parts by weight of water are charged in a kneader mixer and added with 40 parts of fumed silica (Aerosil A 200 produced by Nippon Aerosil Co.) having a specific surface area of 200 $m^2/g$ and continuously stirred as they are for 1 hr, then heated up to an inner temperature of 150° C. and stirred for additional 3 hrs, cooled to a temperature of not more than 100° C., thereafter added with 30 parts of dimethylpolysiloxane (1) which is similar to that of Example 1 and continuously stirred for at least 15 min to obtain a liquids silicone rubber base (11).

To the liquids silicone rubber base (11) are added and mixed with 10 parts of the abovedescribed dimethylpolysiloxane (1), 2.3 parts of methylhydrogenpolysiloxane (4), 0.20 part of a solution of 1% chloroplatinic acid in ethylhexanol and 0.02 part of ethynylhexanol in a planetary mixer. Then, the mixture is defoamed to obtain a silicone rubber composition (K1). The composition has a viscosity of 1,200 poises at 25° C. measured by a rotatory viscosimeter (BH-7-20). Curing property T50 is 3 min and 10 sec.

The composition is cast by means of a metering charger in a mold in the same manner as in Example 1. However, unfilled portions remain in the portion of the formed products before the shade thereof, because of its high viscosity of 1,200 poises. Namely, in 50 product insulators shown in FIG. 1, 46 insulators are good, while the remaining 4 insulators are defects having entrained air. Also, in 50 product insulator pipes shown in FIG. 2, 18 insulators are good, while the remaining 32 insulators are defective having entrained air.

COMPARATIVE EXAMPLE 2

70 parts of dimethylpolysiloxane (1) which is similar to that of Example 1, 80 parts of dimethylpolysiloxane (2)

which is similar to that of Example 1, 50 parts of organopolysiloxane resin (5), 400 parts of aluminum hydroxide having an average particle diameter of 8 μm and a specific surface area of 2 $m^2/g$ and 5 parts of hydrophobic fumed silica (Aerosil R-972) having a specific surface area of 120 $m^2/g$ are charged in a planetary mixer and stirred at 150° C. for 1 hr. After being cooled to room temperature, the mixture is added and mixed with 12 parts of methylhydrogenpolysiloxane (4) which is similar to that of Example 1, 0.50 part of a solution of 1% chloroplatinic acid in ethyl hexanol and 0.02 part of ethynylhexanol in the planetary mixer and then defoamed to obtain a silicone rubber composition (K2). The composition (K2) has a viscosity of 410 poises at 25° C. measured on a rotatory viscosimeter (BL-4-6). T50 is 28 sec.

A test of casting the composition in the mold for forming is impossible, because the rubber cured near the casting inlet to make casting impossible, as can be presumed from the short period of T 50 of 28 sec. Namely, forming tests are tried five times in an effort to obtain the insulator shown in FIG. 1, but the casting of the composition in all the five tests failed, so that the succeeding casting moldings tests are abandoned.

COMPARATIVE EXAMPLE 3

70 parts of dimethylpolysiloxane (1) which is similar to that of Example 1, 80 parts of dimethylpolysiloxane (2) which is similar to that of Example 1, 50 parts of organopolysiloxane resin (5), 400 parts of aluminum hydroxide having an average particle diameter of 8 μm and a specific surface area of 2 $m^2/g$, 5 parts of hydrophobic fumed silica Aerosil R-972) having a specific surface area of 120 $m^2/g$ are charged in a planetary mixer and stirred at 150° C. for 1 hr. After being cooled to room temperature, the mixture is added and mixed with 12 parts of methylhydrogenpolysiloxane (4) which is similar to that of Example 1, 0.20 part of a solution of 1% chloroplatinic acid in ethyl hexanol and 0.10 part of ethynylhexanol in the planetary mixer and then defoamed to obtain a silicone rubber composition (K3). The composition (K3) has a viscosity of 410 poises at 25° C. measured on a rotatory viscosimeter (BL-4-6). T 50 is 19 min.

Tests of casting the composition in the mold for forming the insulator shown in FIG. 1 and the insulator pipes shown in FIG. 2 are performed respectively one time. However, the formed products are only half-cured state as can be presumed from the long T50 of 19 min, so that the succeeding casting moldings tests are abandoned.

COMPARATIVE EXAMPLE 4

70 parts of dimethylpolysiloxane (1) which is similar to that of Example 1, 80 parts of dimethylpolysiloxane (2) which is similar to that of Example 1, 50 parts of organopolysiloxane resin (5), 1,000 parts of aluminum hydroxide having an average particle diameter of 8 μm and a specific surface area of 2 $m^2/g$ and 5 parts of hydrophobic fumed silica (Aerosil R-972) having a specific surface area of 120 $m^2/g$ are charged in a planetary mixer and stirred at 150° C. for 1 hr. After being cooled to room temperature, the mixture is added and mixed with 12 parts of methylhydrogenpolysiloxane (4) which is similar to that of Example 1, 0.50 part of a solution of 1% chloroplatinic acid in ethyl hexanol and 0.02 part of ethynylhexanol in the planetary mixer and then defoamed to obtain a silicone rubber composition (K4). The composition (K4) has a viscosity of 3,000 poises at 25° C. measured on a rotatory viscosimeter (BS7-10). T 50 is 6 min and 20 sec.

Tests are performed of casting the composition in the mold for forming the insulators or insulator pipes but took twice more long time for casting the composition than usual casting for the fault of the high viscosity of 3,000 poises. After the curing, the state of the formed products is inspected to find that all the products have entrainment of air and an unfilling portion at the shade. Tests are performed five times for the insulator shown in FIG. 1 and twice for the insulator pipe shown in FIG. 2, however, all the products are defected, so that the succeeding casting moldings tests are abandoned.

COMPARATIVE EXAMPLE 5

60 parts of dimethylsiloxane/diphenylsiloxane copolymer (7) of a polymerization degree of around 180 having respectively a vinyldimethylsiloxyl group at the both terminal ends of the polymer chain for closing, 10 parts of hexamethyldisilazane and 4 parts by weight of water are charged in a kneader mixer and added with 40 parts of fumed silica (Aerosil A 200 produced by Nippon Aerosil Co.) having a specific surface area of 200 $m^2/g$ and continuously stirred as they are for 1 hr, then heated up to an inner temperature of 150° C. and stirred for an additional 3 hrs, cooled to a temperature of not more than 100° C., thereafter added with 30 parts of dimethylsiloxane/diphenylsiloxane copolymer (7) and continuously stirred for at least 15 min to obtain a liquids silicone rubber base (111).

The silicone rubber base (111) is added with 40 parts of dimethylsiloxane/diphenylsiloxane copolymer (9), 5.8 parts of organohydrogenpolysiloxane resin (4), 0.20 part of a solution of 1% chloroplatinic acid in ethyl hexanol and 0.02 part of ethynylhexanol in a planetary mixer and then defoamed to obtain a silicone rubber composition (K5). The composition (K5) has a viscosity of 740 poises at 25° C. measured on a rotatory viscosimeter (BL-4-6). T50 is 3 min and 48 sec.

The cured products obtained by casting the composition in the mold have no unfilling portion and show good cured state. Namely, 50 insulators shown in FIG. 1 and 50 insulator pipes shown in FIG. 2 are produced in Comparative Example 5, and all the 100 insulators and insulator pipes in total are satisfactory.

The products are tested on a tracking wheel test specified by CEA LWIWG-01(91)in the same manner as in Example 1. As a result, a sign of tracking is ascertained after the elapse of 950 cycles, so that the tracking wheel test is discontinued at 1,000 cycles and confirmation is made to find tracking. Therefore, the required standard 3,000 cycles can not clear.

Although the present invention has been explained with specific examples and numeral values, it is of course apparent to those skilled in the art that various changes and modifications thereof are possible without departing from the broad spirit and aspect of the present invention as defined in the appended claims.

What is claimed is:

1. A polymer insulator comprising a core made of a glass fiber reinforced synthetic resin, and an addition curing silicon rubber composition having a viscosity of 50–1,000 poises at 25° C. applied on the outer circumferential surface of the core and cured under heating and having a curing property that requires a time of 1–15 min. to reach a torque of 50% taking the torque at an elapsed time of 30 min. at 80° C. as 100% when measuring its curing property by a discreometer, the silicone rubber composition containing the following components (A), (B), (C) and (D) wherein:

(A) is an alkenyl group-containing organopolysiloxane of a polymerization degree of 100–500 having the following average compositional formula:

$$R^1_aR^2_bSiO_{(4-a-b)/2} \quad (1)$$

wherein $R^1$ is a halogen-substituted or nonsubstituted monovalent hydrocarbon group not having an aliphatic unsaturated bond, at least 90% of the total $R^1$ being a methyl group, $R^2$ is an alkenyl group, a is a number of 1.85–2.10, b is a number of 0.004–0.2, a+b is a number of 1.854–2.30.

(B) is an organohydrogenpolysiloxane having in the molecule at least two hydrogen atoms bonded to silicon atoms and containing the hydrogen atoms bonded to the silicon atoms in an amount capable of supplying 0.5–10 moles of the hydrogen atoms to one mole of the alkenyl group of component (A), (C) is a platinum compound present in a catalytic amount, and (D) is a reinforcing silica having a specific surface area of not less than 50 $m^2/q$ and a primary diameter of not more than 100 nm and present in an amount of 1–40 parts by weight relative to 100 parts by weight of component (A).

2. The polymer insulator of claim 1, wherein the addition-curing silicone rubber composition contains 50–300 parts by weight of aluminum hydroxide relative to 100 parts by weight of the organopolysiloxane of the component (A).

3. The polymer insulator of claim 1, wherein the addition curing silicone rubber composition contains 100–500 parts by weight of spherical fused silica of an average particle diameter of not more than 40 $\mu$m relative to 100 parts by weight of the organopolysiloxane of the component (A).

4. The polymer insulator of claim 1, wherein the addition curing silicone rubber composition contains 5–200 parts by weight of an organopolysiloxane resin of the following general formula:

$$(R^3_3SiO_{1/2})x(SiO_2)y \quad (4)$$

wherein $R^3$ is a halogen-substituted or nonsubstituted monovalent hydrocarbon group, a portion of $R^3$ being an alkenyl group and contained in an amount of 0.00001–0.005 mole per 1 g of organopolysiloxane, x and y are such positive number of satisfying the conditions of $0.5 \leqq x/y \leqq 1.5$ and $x+y=1$.

* * * * *